United States Patent [19]

Grau

[11] 4,377,315

[45] Mar. 22, 1983

[54] CIRCUIT BOARD KEYING ARRANGEMENT

[75] Inventor: Thomas G. Grau, Mendham Township, Morris County, N.J.

[73] Assignee: Bell Telephone Laboratories, Incorporated, Murray Hill, N.J.

[21] Appl. No.: 232,424

[22] Filed: Feb. 9, 1981

[51] Int. Cl.[3] ..... H01R 13/64

[52] U.S. Cl. ..... 339/17 R; 339/113 R; 339/176 MP; 339/184 M

[58] Field of Search ..... 339/17 R, 113, 147 R, 339/147 P, 176 MP, 184 R, 184 M, 185 R, 186 M; 340/825.32

[56] References Cited

U.S. PATENT DOCUMENTS

| | | | |
|---|---|---|---|
| 3,177,461 | 4/1965 | Hagan et al. | 339/184 |
| 3,246,279 | 4/1966 | Storcel | 339/17 |
| 3,641,498 | 2/1962 | Hedin | 340/164 R |
| 3,872,435 | 3/1975 | Cestaro | 340/147 MD |
| 3,911,398 | 10/1975 | Vogel | 340/149 A |
| 4,017,770 | 4/1977 | Valfre | 339/176 MP |
| 4,084,875 | 4/1978 | Yamamoto | 339/113 R |
| 4,223,973 | 9/1980 | Tamburro | 339/186 M |
| 4,239,323 | 12/1980 | Tamburro | 339/186 M |
| 4,327,353 | 4/1982 | Beard et al. | 340/64 |

*Primary Examiner*—John McQuade
*Assistant Examiner*—Gary F. Paumen
*Attorney, Agent, or Firm*—C. H. Davis

[57] ABSTRACT

An arrangement for keying plug-in circuit boards and their receptacles so that a user is alerted visually and audibly if an attempt is made to insert a board into an improper receptacle. Contacts on the board are arranged in coded locations along the edges of the board which slide into the guide rails of the receptacles. Contact assemblies are mounted on the guide rails in a similar coded arrangement. The contacts and contact assemblies are positioned in such a manner that at least one board contact will electrically engage a receptacle contact assembly and energize an alarm before the board can be fully inserted into an improper receptacle.

13 Claims, 7 Drawing Figures

101
102
103
104
105
107
108
109
110
111
113
114
117
203
213
214
215
216
217
314
315
316
317
414
416
417
503
514
515
516
517
A
B
C
D
E
F
A'
B'
C'
D'
E'
F'
a
b
c
d
e
f
a'
b'
c'
d'
e'
f'

CIRCUIT BOARD KEYING ARRANGEMENT

TECHNICAL FIELD

This invention relates to plug-in circuit boards and particularly to arrangements for preventing the insertion of an improper circuit board into a receptacle. In a more particular aspect, this invention relates to apparatus for indicating when an attempt is made to insert the wrong circuit board into any receptacle but the correct one.

BACKGROUND OF THE INVENTION

Many large electronic systems are designed as modular systems wherein a large number of a few types of circuits are used. Typically, the circuits are mounted in circuit boards which are inserted into receptacles on a frame. In addition to holding the circuit board firmly in place, the receptacle contains contacts which electrically engage terminals on the board to provide electrical connections between the wiring on the frame and the circuitry mounted on the board.

For economic and manufacturing reasons, the boards that contain different circuits for the system are, nevertheless, usually compatible with all receptacles in the system. Thus, without some form of restraint, any board could be inserted into any receptacle whether or not the board contains the correct circuitry. This makes the system unreliable, difficult to maintain, and subject to human error when faulty circuit boards have to be replaced.

To avoid the problems of plugging improper devices into receptacles, so called "keying" arrangements have been devised. A common example is the use of different orientations of contact members on male and female plugs and receptacles for devices that have different voltage or current ratings.

Although the use of different contact arrangements can be used for keying plug-in circuit boards, this requires each type of circuit to have its own unique contact arrangement thus complicating the manufacturing of the boards and receptacles.

Other mechanical keying arrangements for circuit boards are known in the prior art such as those disclosed in U.S. Pat. No. 3,177,461 to T. G. Hagen et al of Apr. 6, 1965, and U.S. Pat. No. 3,246,279 to J. A. Storcel of Apr. 12, 1966.

In Hagen et al, tubular members are mounted in a receptacle and on the circuit board along a common axis parallel to the direction of the insertion of the board. A portion of the tubular member on the board is removed along with a corresponding portion of the tubular member in the receptacle. The proper board can be inserted in the receptacle only when the tubular member on the board intermeshes with its mate in the receptacle.

Storcel, on the other hand, shows notches made in the circuit board which correspond to unequal length slots in the receptacle which act as guide rails for the circuit board. Thus, if the circuit board is reversed, it cannot be fully inserted into its receptacle due to the notches engaging the stops on the slots.

While the above-cited examples are wholly suited for their intended purposes, they rely on the physical restraint of an improper circuit board.

Thus, one might try to insert an improper board into a receptacle and, upon hitting one of the stops, think that the board is properly in place. If the improper board is forced into the receptacle, the board or restraining mechanism might be damaged and, if the electrical connection is made via the connector, damage may be imparted to the entire electronic system.

DISCLOSURE OF THE INVENTION

The foregoing problem is solved and a technical advance is achieved by a plug-in circuit board keying arrangement which audibly and/or visually informs the user when an attempt is made to insert an improper board into a receptacle. More specifically, a circuit board is arranged with a first contact member mounted on the board in one of a plurality of coded locations along an axis parallel to the direction of insertion of the board into the receptacle. A second contact member is also mounted on the board in an associated one of a like plurality of coded locations along a similar axis. Each one of the first locations is associated with a corresponding one of the second locations and the first and second locations are ordered in opposite directions. Taken together, the first and second locations define a unique key.

Located along the guide rails which, in turn, position the board for insertion into the receptacle are first and second contact assemblies. The first and second contact assemblies are located in the same spatial relationship as the contact members on the board and are coupled to an alarm indicating circuit.

When the correct board is inserted into the receptacle, the contact members on the board do not engage the corresponding contact assemblies on the guide rails either during the insertion of the board and when it is fully inserted. If an improper board is inserted, however, one of the contact members engages a contact assembly to activate the alarm indicating circuit before the board can be fully inserted.

In the preferred embodiment of the invention, the circuit board contains two light emitting diode (LEDs) to visually inform the user whether an improper board has been inserted. One LED is energized along with an audible alarm circuit to indicate that the board is improper. The other LED is coupled to terminals which plug into the connector portion of the receptacle. This indicates to the user that the proper plug-in circuit board is electrically engaged with the receptacle.

DETAILED DESCRIPTION

Figures 1, 2, 3, 4, 5:
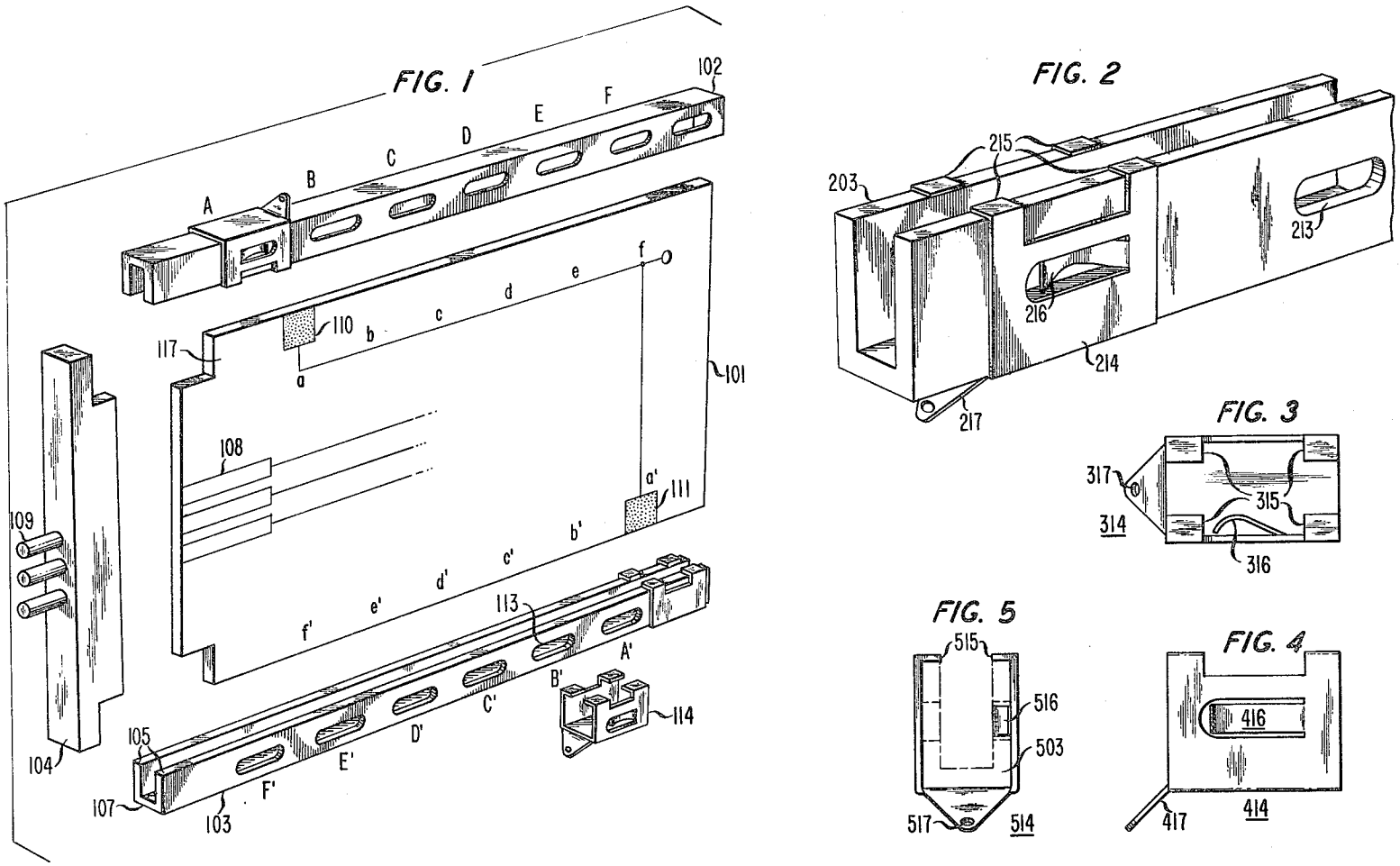
FIG. 1 shows an exploded perspective view of one embodiment of the invention comprising a circuit board and receptacle including upper and lower guide rails with associated contact assemblies and a connector for receiving the contact terminals of the circuit board.
FIG. 2 shows an enlarged view of a portion of a guide rail with a contact assembly mounted thereon.
FIGS. 3, 4, and 5 show a plan view, a side view, and an end view, respectively, of a typical contact assembly according to the invention.

In the drawings, reference numerals have been selected so that the first digit corresponds to the figure number, and whenever possible in FIGS. 1–7, the remaining digits are the same for similar apparatus which may appear in the various figures. For example, the circuit board designated 101 in FIG. 1 is designated 601 in FIG. 6, etc.

FIG. 1 shows a perspective view of a circuit board 101 inserted into a receptacle. For purposes of this discussion, the receptacle comprises an upper guide rail 102 and a lower guide rail 103 of nonconducting material, and a connector 104. Each guide rail is U-shaped to form a channel having two parallel side walls 105 and a bottom portion 107 which receives one edge of the circuit board to firmly support it and guide the circuit board into alignment with connector 104. When board 101 is fully inserted into the receptacle, terminals such as 108 which connect to circuitry on the board are in electrical engagement with mating contacts (not shown) in connector 104. The mating contacts are electrically connected with pins 109 on which the back plane wiring for external circuitry is terminated.

Ordinarily, a plurality of guide rails and connectors are adjacently mounted on a frame housing in a well-known manner to accommodate a large number of circuit boards. The electrical wiring to pins 109 is such that when the circuit boards are inserted in their proper receptacles, the overall system operates to accomplish its desired functions.

Circuit board 101 is provided with two electrical contact elements or conductive members 110 and 111 which are located on the front surface 117 of the board as shown in FIG. 1 at the positions a and a′, respectively. As will be seen, these locations are coded along with similar locations on the guide rails to form a scheme to assure that a circuit board is inserted into the proper receptacle.

On the back surface (not shown in FIG. 1) of board 101 is a conductive strip which extends along the lower edge of the board. This strip is better seen in FIG. 7 where it is designated 712.

The conductive members 110 and 111 and conductive strip 712 are electrically connected to alarm indicating circuitry which will be described below.

Each guide rail contains a plurality of elongated apertures, such as aperture 113, in both vertical side walls 105 of the U-shaped channel. The apertures are located along the upper guide rail 102 in positions A through F and along the lower guide rail 103 in corresponding positions A′ through F′. The apertures are arranged to accept an electrical contact assembly such as 114 so that the contact assembly can electrically engage a conductive member such as 111 or the conductive strip 712 when a circuit board is inserted in the guide rail.

Each of the apertures in locations A through F is associated with an aperture in locations A′ through F′. Similarly, each of the locations a through f of conductive members on the upper edge of the board is associated with a location a′ through f′ on the lower edge of the board. These locations are chosen such that neither of the conductive elements 110 or 111 will be positioned under an aperture containing a contact assembly when a circuit board is in its proper receptacle. On the other hand, if a board is inserted in an improper receptacle, a contact assembly 114 will engage a conductive member before the board can be fully inserted into connector 104.

A typical contact assembly is shown in FIGS. 3, 4 and 5 and designated 314, 414 and 514, respectively. The contact assembly has a substantially U-shaped configuration when viewed from its end as shown in FIG. 5. The U-shape conforms to the outside shape of a guide rail 503 and also consists of restraining tabs 515 which partially surround the guide rail and thereby secure its attachment thereto.

The contact assembly also includes a wiper arm designated 316 in the top view of FIG. 3. When the contact assembly is positioned on a guide rail, the wiper arm is arranged to protrude through an aperture to be in physical contact with a circuit board and thereby engage a conductive strip or member when a board is inserted in the rail. As shown in the side elevation, FIG. 4, the wiper arm 416 is affixed to the contact assembly in a cantilever manner so that one end of the wiper arm is free to move and yet bear against a circuit board when the board is in the guide rail. The contact assembly, and particularly the wiper arm, is made of electrically conducting material with sufficient resiliency so that the arm slightly deforms when the board is inserted and yet applies sufficient pressure to make good electrical contact with a conductive member on the board. Contact assembly 314 also includes a terminal 317 for the convenient connection of external circuitry.

FIG. 2 shows a perspective view of a portion of the guide rail and how a contact assembly attaches thereto. Although not shown in FIG. 2, it should be noted that the apertures in the guide rail can appear in both vertical members so that a contact assembly can be mounted to permit the wiper arm to engage either side of the circuit board.

Figure 6:
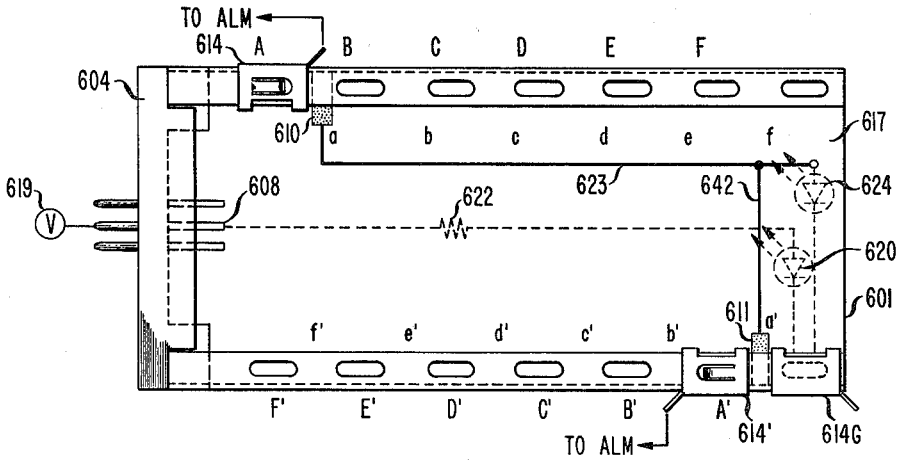
FIG. 6 shows a left side view of the plug-in board and receptacle with the plug-in board fully inserted in the proper receptacle.
Figure 7:
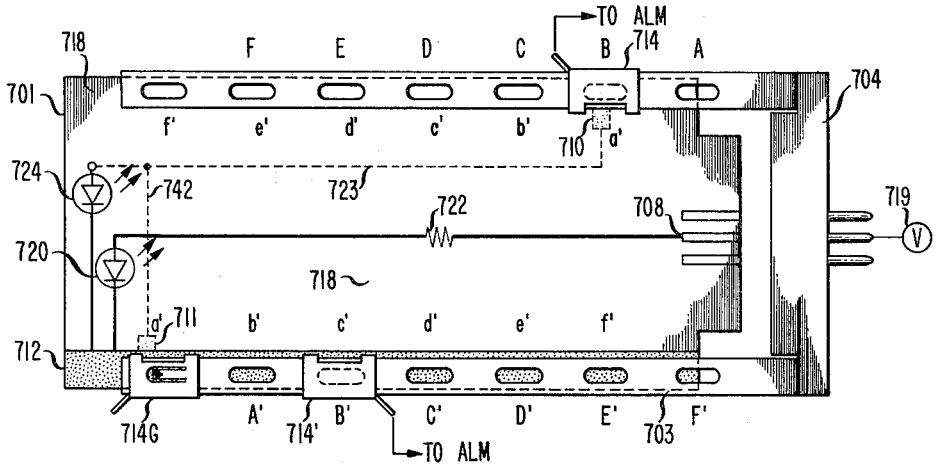
FIG. 7 shows the right side view of a plug-in board which is partially inserted in the wrong receptacle.

To better understand the novel keying arrangement, a description will now be given with reference to FIGS. 6 and 7 taken together. It will be recalled that the circuit board has conductive members on both front and back surfaces. The front surface 117 referred to in FIG. 1 is equivalent to the front surface 617 shown in FIG. 6. FIG. 6 shows a card 601 fully inserted in its proper receptacle so that the terminals (such as 608) on the circuit board fully engage the connector 604. FIG. 7, on the other hand, shows the reverse or back side 718 of circuit board 701 which has been partially inserted in an incorrect receptacle.

Turning first to FIG. 6, the reader will note that contact assemblies 614 and 614′ are located at positions A and A′ on the upper and lower guide rails, respectively. Also, conductive members 610 and 611 are located at board portions a and a′, respectively, and these conductive members are connected together via conductors 623 and 622 to an LED 624 on the back side of the board. The other terminal of the LED is connected to the conductive strip (not shown), but located on the back side of circuit board 601. The conductive strip is better seen in FIG. 7 wherein it is designated 712 and shown connected to LED 724. LED 724 will be energized when a board is inserted in an improper receptacle before the board is fully inserted as hereinafter described.

In FIG. 7, it can also be seen that LED 720 is connected between conductive strip 712 and terminal 708 via resistor 722. When a circuit board is inserted in guide rail 703, the wiper arm of contact assembly 714G connects ground to conductive strip 712. If the board has been fully inserted in the proper receptacle, voltage source 719 would be connected via terminal 708 through resistance 722, LED 720, conductive strip 712, and contact assembly 714G to ground thereby energizing LED 720. This informs the user that the circuit board has been inserted in the proper receptacle and power is being supplied to the board.

However, it has been assumed that the circuit board and receptacle shown in FIG. 7 are mismatched and LED 720 would not be energized before the alarm is activated. In FIG. 6 a properly matched circuit board and receptacle are shown and LED 620 on the back side of the board would be energized when the board is fully inserted in the receptacle.

Figure 8:
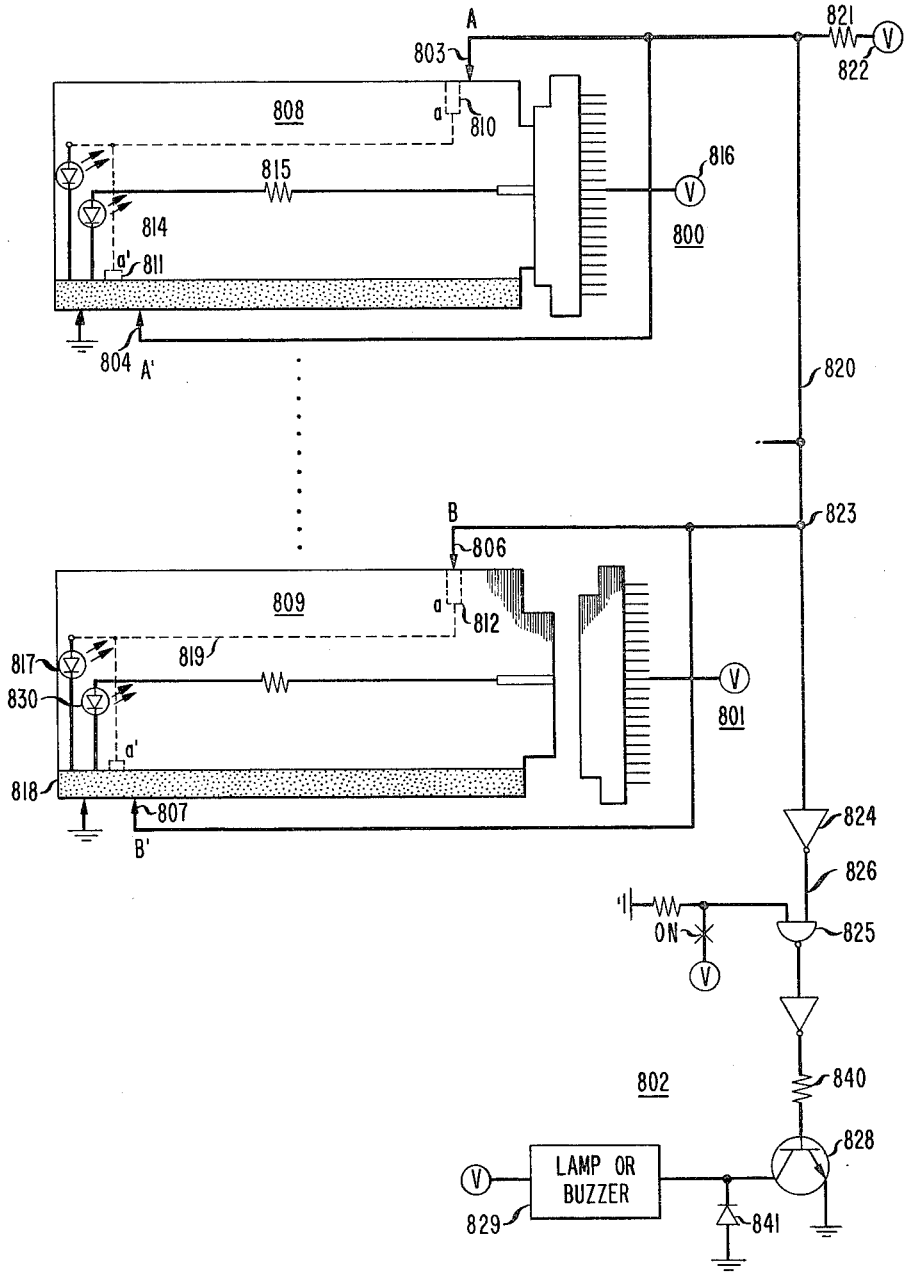
FIG. 8 shows a schematic of two plug-in circuit boards and an alarm circuit which is energized when a board is plugged into an improper jack.

The contact assemblies 614 and 614' in FIG. 6, and 714 and 714' in FIG. 7, are connected to an alarm indicating arrangement which is shown in FIG. 8 and will be described below. It will be noted in FIG. 6 that when board 601 is fully inserted into connector 604, neither conductive members 610 or 611 at a or a', respectively, engage a corresponding contact assembly 614 (positioned in location A) or contact assembly 614' (positioned in location A'). However, if the same board were partially inserted into the incorrect receptacle, such as the receptacle shown in FIG. 7, one or the other of the conductive members would engage a contact assembly to actuate the alarm. More specifically, and with reference to FIG. 7, contact assembly 714 is positioned over the aperture at location B while assembly 714' is positioned at location B' which defines a code other than the code represented by the location of conductive members 710 and 711 on board 701. Before board 701 is fully inserted in the receptacle as shown in FIG. 7, conductive member 710 electrically engages contact assembly 714. Thus, a path is completed from the alarm circuit (not shown in FIG. 7) via contact assembly 714 and conductive member 710, over conductor 723 to LED 724 on surface 718, over conductive strip 712 and contact assembly 714G to ground (not shown). The circuit is completed for actuating the alarm and energizing the LED 724 to inform the maintenance personnel that a circuit board has been inserted in the wrong receptacle.

Thus, the locations A through F along the upper guide rail, and A' through F' along the lower guide rail indicate illustrative locations for the aperture at which a contact assembly can be located. Each one of the locations A through F is individually associated with a correspondingly designated location A' through F', and the A through F locations are arranged and ordered in a direction opposite to the A' through F' locations. This permits each associated pair of locations to define a unique key for each type of circuit board. In other words, mounting contact assemblies at locations A and A' would form one key, B and B' would form another key, etc.

The correct circuit board for any given receptacle would, likewise, have conductive members a through f and a' through f' located thereon in a similar keying arrangement as the receptacle keying arrangement. That is to say, the circuit board having conductive members positioned at a and a' as shown in FIG. 6 would be the correct board for insertion in the receptacle having contact assemblies at A and A'.

The contact assembly locations and the conductive member locations are merely illustrative and it will be understood that the position and member of locations can be altered to suit the needs of a particular system. For example, the associated locations could be on opposite faces along the same edge of the board instead of opposite edges of the same face as shown in the drawing.

Turning now to FIG. 8, FIG. 8 shows two receptacles generally designated 800 and 801 connected to an alarm circuit, generally designated as 802. Receptacle 800 has contacts 803 and 804 positioned at coded locations A and A', respectively. Receptacle 801, however, has its contacts 806 and 807 positioned at coded locations B and B', respectively. Thus, receptacle 800 will accept a proper circuit board such as 808, which has contact members 810 and 811 located on the backside of the board at positions a and a', while similarly coded circuit board 809 will not be accepted by receptacle 801 before the alarm is actuated.

In the upper portion of FIG. 8, circuit board 808 is fully inserted in receptacle 800 and ground is extended through LED 814, resistance 815 to voltage source 816. LED 814 is energized informing the user that "all seems well" and power has been connected to the circuit board. It will be noted that contact 803 does not engage conductive member 810 and contact 804 does not engage conductive member 811 to complete the circuit for actuating the alarm circuit 802. In other words, the circuit board having the conductive members at coded locations a and a' is the proper board for insertion into a receptacle which is similarly coded by having its contacts positioned at locations A and A'.

In the lower half of FIG. 8, circuit board 809 is shown partially inserted into receptacle 801. Circuit board 809 is coded so that its conductive members are located on the backside of the board at a and a'; however, receptacle 801 is coded so that its contacts 806 and 807 are at locations B and B', respectively. When board 809 is partially inserted into receptacle 801, contact 806 engages conductive member 812 before the connector engages the terminals on the circuit board to activate the circuit on the board. This completes a circuit from ground, through conductive strip 818 and LED 817, over conductor 819, through conductive member 812 and contact 806, over conductor 820 and through resistance 821 to voltage source 822.

The voltage change at node 823 is inverted by inverter 824 and applied to NAND gate 825 over conductor 826. When the circuit is activated by switch ON, NAND gate 825 is enabled, and its output is inverted and applied to the base of transistor 828 through resistance 840. Transistor 828 turns on and activates lamp or buzzer circuit 829. Diode 841 is provided to protect transistor 828 from negative potentials on its collector. Circuit 829 is an alarm device to indicate that an attempt has been made to insert a circuit board into the wrong receptacle. LED 817 is also energized to inform the person attempting to insert the board that it is being placed in the wrong receptacle. All seems well LED 830 is not energized at this time since the circuit board has not been fully inserted into the receptacle.

In summary, apparatus has been described for keying circuit boards to mating receptacles to minimize the insertion of the wrong board into a receptacle by warning the user before the improper board is fully inserted.

It is to be understood that the above-described arrangements are merely illustrative of the principles and applications of the invention and that other arrangements may be devised by those skilled in the art without departing from the spirit and scope of the invention. For example, the conductive members and contact assemblies need not be located in both the upper and lower guide rails, but can be located in either guide rail using both front and back sides of the circuit board. Also, the number and spacing of the conductive members and contact assemblies can be altered to accommodate a given system wherein a greater number of unique keys is required.

What is claimed is:

1. For use with circuit boards that plug into matching receptacles, an arrangement for indicating the insertion of a board into any but a matching receptacle characterized by a plurality of contact pairs each having a first contact adapted for engagement with a second contact, said first contact and said second contact of each pair respectively located on said circuit board and said receptacle in selectable locations along individual rows colinear with the direction of insertion, and means for indicating when the contacts of a said pair are engaged, wherein said contacts are mounted at row locations selected so that at least the contacts of one of said pairs are engaged before a mismatched circuit board is fully inserted in said receptacle.

2. The invention defined in claim 1 wherein said indicating means comprises visual indicating means and audible indicating means.

3. The invention defined in claim 2 wherein said visual indicating means comprises a light emitting device located on said board and coupled to at least one of said first contacts, and wherein said audible indicating means comprises an alarm circuit coupled to at least one of said second contacts.

4. The invention defined in claim 3 wherein is further provided additional indicating means energized when said circuit board is fully inserted into a matching one of said receptacles.

5. The invention defined in claim 4 wherein said receptacle includes means for electrically connecting to circuitry external of said board, wherein said circuit board includes a terminal adapted for electrical engagement with said connecting means when said circuit board is fully inserted in said receptacle, and wherein said additional indicating means comprises a light emitting device coupled to said terminal.

6. The invention defined in claim 1 wherein said receptacle comprises a first and a second guide rail of electrically nonconducting material and adapted to receive a first and second edge of said board for guiding said board into said receptacle and wherein each guide rail comprises means for positioning a said second contact at each of said locations.

7. The invention defined in claim 6 wherein each said guide rail comprises a channel member including at least two side walls and a web for maintaining said side walls in parallel relationship to secure one edge of said circuit board between said side walls and wherein said positioning means comprises a plurality of apertures in at least one of said side walls.

8. The invention defined in claim 7 wherein each said second contact comprises an electrically conductive member adapted to engage at one of said apertures a surface of said circuit board and wherein each said first contact comprises an electrically conductive member affixed to said surface.

9. The invention defined in claim 6 wherein each said guide rail comprises a channel having a substantially U-shaped cross section including two side members and a bottom member, wherein said positioning means comprises a plurality of apertures in at least one of said channel side members, wherein each said second contact comprises a contact assembly having two side pieces each joined along a first edge to a bottom piece to form a substantially U-shaped assembly whose internal cross-sectional dimensions substantially coincide with the external cross-sectional dimensions of said channel for engagement therewith, and wherein at least one of said side pieces includes a wiper arm mounted in a cantilever manner thereon to protrude through one of said apertures when said contact assembly is positioned to engage said channel.

10. The invention defined in claim 9 wherein each said side piece includes a tab portion at the edge opposite said bottom piece to secure said assembly to said channel.

11. For use with circuit boards that plug into matching receptacles, an arrangement for indicating the insertion of a board into any but a matching receptacle characterized by a first contact located along a first edge of said board in one of a plurality of first coded locations colinear with the direction of insertion of said board, a second contact located along a second edge of said board in one of a like plurality of second coded locations colinear with the direction of insertion of said board, wherein each first location is associated with a different one of said second locations and the first and second locations being ordered in opposite directions, a plurality of receptacles each having first and second contact assemblies associated, respectively, with said first and second contacts of said circuit board wherein the contact assemblies of a matching one of said receptacles are located in the same general spatial relationship as their respective associated contacts such that neither assembly engages its contact before said board is fully inserted into said matching receptacle and the contact assemblies of a mismatched one of said receptacles being located in a different spatial relationship than the respective associated contacts such that at least one assembly engages its associated contact before said board is fully inserted into said mismatched receptacle, and means for indicating the engagement of a said contact assembly with one of said contacts.

12. The invention defined in claim 11 wherein each said receptacle comprises a guide rail adapted to receive each said edge for supporting said board in a said receptacle and means for positioning said contact assemblies at discrete locations.

13. The invention defined in claim 12 wherein said indicating means comprises visual indicating means, means electrically coupling said visual indicating means to said first and second contacts, an alarm circuit and means electrically connecting said alarm circuit to said contact assemblies wherein said visual indicating said alarm circuit are energized upon engagement of one of said contacts with one of said contact assemblies.

* * * * *